US007968265B2

(12) United States Patent
Sugimoto et al.

(10) Patent No.: US 7,968,265 B2
(45) **Date of Patent: *Jun. 28, 2011**

(54) TONER, DEVELOPER, TONER CONTAINER, PROCESS CARTRIDGE, IMAGE FORMING METHOD, AND IMAGE FORMING APPARATUS

(75) Inventors: Tsuyoshi Sugimoto, Mishima (JP); Hiroshi Yamashita, Numazu (JP); Naohiro Watanabe, Sunto-gun (JP); Shinichi Wakamatsu, Numazu (JP); Masaki Watanabe, Namazu (JP)

(73) Assignee: Ricoh Company, Limited, Tokyo (JP)

( * ) Notice: Subject to any disclaimer, the term of this patent is extended or adjusted under 35 U.S.C. 154(b) by 71 days.

This patent is subject to a terminal disclaimer.

(21) Appl. No.: 12/393,196

(22) Filed: Feb. 26, 2009

(65) Prior Publication Data

US 2009/0214973 A1 Aug. 27, 2009

(30) Foreign Application Priority Data

Feb. 26, 2008 (JP) ..... 2008-044931

(51) Int. Cl.
*G03G 9/08* (2006.01)

(52) U.S. Cl. ..... 430/108.4; 430/109.4

(58) Field of Classification Search ..... 430/108.4, 430/109.4

See application file for complete search history.

(56) References Cited

U.S. PATENT DOCUMENTS

| | | | | |
|---|---|---|---|---|
| 7,645,550 | B2 * | 1/2010 | Yuasa et al. | 430/108.4 |
| 2004/0142263 | A1 | 7/2004 | Mikuriya et al. | |
| 2008/0070151 | A1 * | 3/2008 | Sugimoto et al. | 430/112 |
| 2008/0318148 | A1 | 12/2008 | Sugimoto et al. | |

FOREIGN PATENT DOCUMENTS

| | | |
|---|---|---|
| EP | 1 686 426 A2 | 8/2006 |
| EP | 1 686 426 A3 | 8/2006 |
| JP | 04-070765 | 3/1992 |
| JP | 2004-245854 | 9/2004 |
| JP | 2006-208609 | 8/2006 |
| JP | 2006-330392 | 12/2006 |
| JP | 2007-233169 | 9/2007 |
| JP | 2008-281884 | 11/2008 |

* cited by examiner

*Primary Examiner* — Hoa V Le

(74) *Attorney, Agent, or Firm* — Oblon, Spivak, McClelland, Maier & Neustadt, L.L.P.

(57) ABSTRACT

A toner is provided that includes a release agent, a colorant, a binder resin including a polyester resin, and a fixing auxiliary component including an ester compound of a fatty acid with an alcohol. The fatty acid includes stearic acid and behenic acid in a total amount of 80% by weight or more. The alcohol includes ethylene glycol in an amount of 80% by weight or more. The ester compound has a hydroxyl value of 10 to 100 mgKOH/g.

14 Claims, 4 Drawing Sheets

TONER, DEVELOPER, TONER CONTAINER, PROCESS CARTRIDGE, IMAGE FORMING METHOD, AND IMAGE FORMING APPARATUS

BACKGROUND OF THE INVENTION

1. Field of the Invention

The present invention relates to a toner for developing an electrostatic latent image in electrophotography, electrostatic recording, and electrostatic printing. In addition, the present invention also relates to a developer, a toner container, a process cartridge, an image forming method, and an image forming apparatus using the toner.

2. Discussion of the Background

In an image forming process such as electrophotography, electrostatic recording, and electrostatic printing, first, an electrostatic latent image is formed on an electrostatic latent image bearing member (hereinafter "electrophotographic photoreceptor" or "photoreceptor"). The electrostatic latent image is then formed into a visible toner image by a developer. The toner image is transferred onto a recording medium such as paper, and finally fixed thereon.

The developer for developing an electrostatic latent image includes one-component developer consisting essentially of magnetic or non-magnetic toner, and two-component developer including toner and carrier.

To fix a toner image on a recording medium in electrophotography, a heating roller method in which a heating roller is directly pressed against the toner image on the recording medium is widely used because of its high energy efficiency. However, the heating roller method requires a great amount of electric power, which is disadvantageous from the viewpoint of energy saving. To overcome such a disadvantage, various attempts have been made to reduce electric power consumption of the heating roller. One proposed approach involves decreasing output of the heating roller while image formation is not occurring (i.e., sleep mode) and increasing it during image formation so that the temperature of the heating roller is increased.

However, the above approach requires several ten seconds until the heating roller recovers from the sleep mode and is heated to an appropriate temperature for fixing, which may cause stress to users. On the other hand, the heating roller is preferably turned off completely while image formation is not occurring so that electric power consumption is reduced. Accordingly, toner is required to be fixable even when the temperature of the heating roller is low.

As described above, recent toners are required to be fixable at low temperatures (this property is hereinafter referred to as low-temperature fixability) and have good heat-resistant storage stability as well. To respond to these requirements, recently polyester resins are used as binder resins because of their excellent low-temperature fixability and affinity for paper, in place of styrene resins that are widely used as binder resins conventionally. For example, Unexamined Japanese Patent Application Publication No. (hereinafter "JP-A-") 2004-245854 discloses a toner including a linear polyester resin having specific properties such as a specific molecular weight. JP-A-04-70765 discloses a toner including a non-linear cross-linked polyester resin formed from a rosin which serves as an acid component.

However, these toners do not function in recent high-speed and energy-saving electrophotographic image forming apparatuses, possibly providing weak fixation strength due to shortening of the fixing time and lowering of the fixing temperature.

It should be noted that the polyester resin formed from a rosin, which is disclosed in JP-A-04-70765, is easily pulverized, resulting in good toner manufacturability in pulverization methods. Further, the polyester resin includes 1,2-propanediol, which is a branched-chain alcohol having 3 carbon atoms, as an alcohol component, which provides better low-temperature fixability without decreasing hot offset temperature compared to resins including an alcohol having 2 carbon atoms or less. The "hot offset" here refers to an undesirable phenomenon in which part of a fused toner image is adhered to the surface of a heat member, and re-transferred onto an undesired portion of a recording medium. In addition, such a polyester resin including a branched-chain alcohol having 3 carbon atoms is able to prevent deterioration of heat-resistant storage stability even when the glass transition temperature is decreased, while a resin including a branched-chain alcohol having 4 carbon atoms or more is not. Accordingly, such a polyester resin is suitable as a binder resin from the viewpoint of low-temperature fixability and heat-resistant storage stability.

However, such a polyester resin will be not able to respond to severe requirements for energy-saving in the near future.

To overcome such a situation, JP-A-2006-208609 discloses a toner including a fixing auxiliary component. The fixing auxiliary component forms crystalline domains thereof in the toner so that the toner provides both heat-resistant storage stability and low-temperature fixability simultaneously. However, this attempt may not be sufficient to respond to the severe requirements for energy-saving.

SUMMARY OF THE INVENTION

Accordingly, an object of the present invention is to provide a toner that has both low-temperature fixability so as to reduce energy consumption and hot offset resistance so as not to contaminate a fixing device or a resultant image.

Another object of the present invention is to provide a developer, a toner container, a process cartridge, an image forming method, and an image forming apparatus that provide high-definition and high-quality images for an extended period of time.

These and other objects of the present invention, either individually or in combinations thereof, as hereinafter will become more readily apparent can be attained by a toner, comprising:

a release agent;

a colorant;

a binder resin comprising a polyester resin; and a fixing auxiliary component comprising an ester compound of a fatty acid with an alcohol, wherein the fatty acid comprises stearic acid and behenic acid in a total amount of 80% by weight or more, the alcohol comprises ethylene glycol in an amount of 80% by weight or more, and the ester compound has a hydroxyl value of 10 to 100 mgKOH/g; and a developer, a toner container, a process cartridge, an image forming method, and an image forming apparatus using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
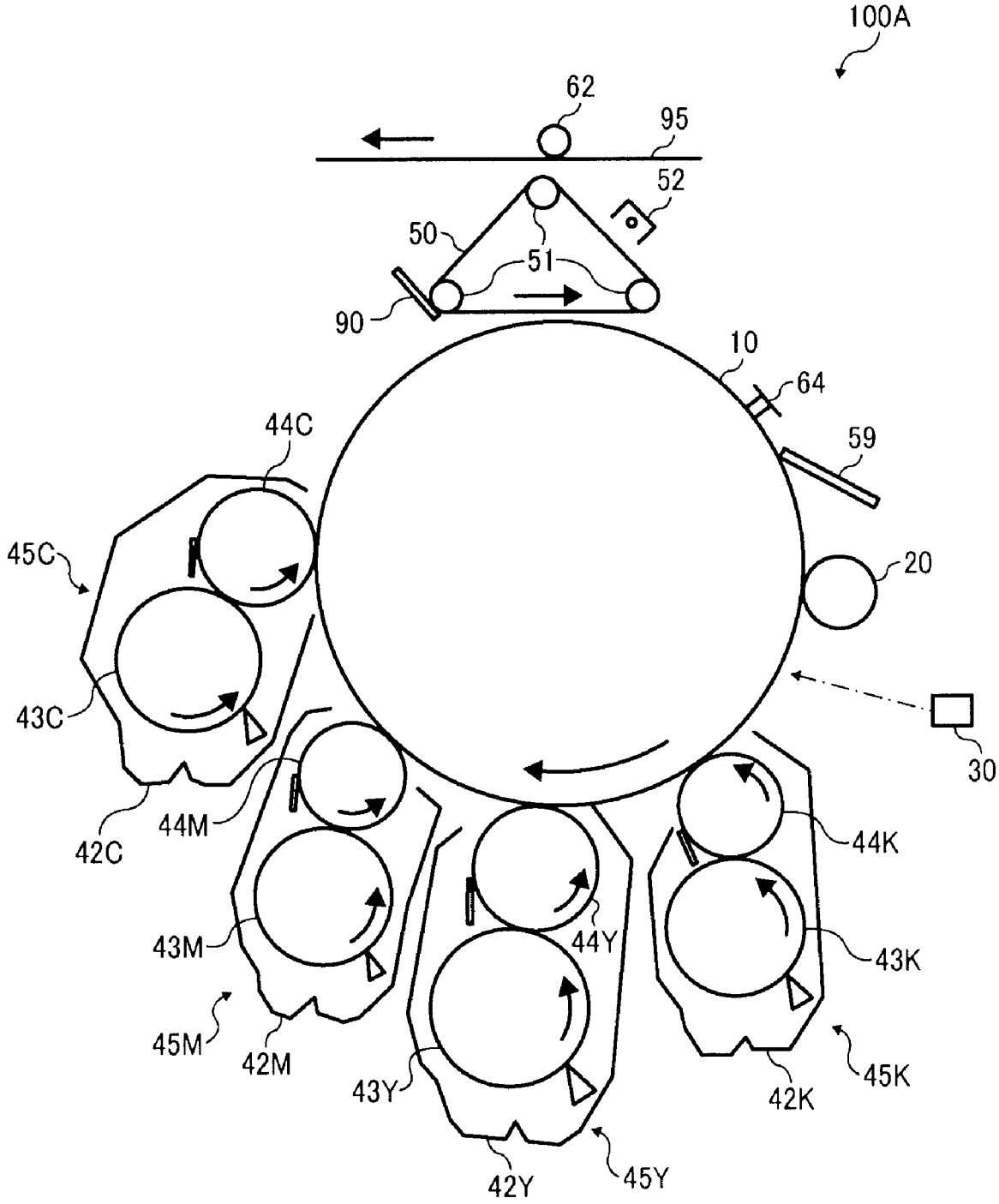
FIG. 1 is a schematic view illustrating an embodiment of an image forming apparatus of the present invention.

Generally, the present invention provides a toner comprising a release agent, a colorant, a binder resin comprising a polyester resin, and a fixing auxiliary component.

When heat is not applied to the toner, namely when the toner is not subjected to fixing, the fixing auxiliary component exists in the toner forming crystalline domains thereof incompatible with the binder resin. Upon application of heat, namely when the toner is subjected to fixing, the fixing auxiliary component rapidly melts so as to accelerate softening of the binder resin. Accordingly, the toner has good heat-resistant storage stability before being fixed because the binder resin does not soften. On the other hand, the toner provides good low-temperature fixability at the time being fixed because softening of the binder resin is accelerated.

The fixing auxiliary component comprises an ester compound of a fatty acid with an alcohol, and has a melting point of 60 to 85° C., preferably 65 to 80° C., and more preferably 70 to 75° C. The fatty acid comprises stearic acid and behenic acid in a total amount of 80% by weight or more, preferably 90% by weight or more, and more preferably 100%. The alcohol comprises ethylene glycol in an amount of 80% by weight or more, preferably 90% by weight or more, and more preferably 100%. Because of having high compatibility with polyester resins, such an ester compound rapidly softens the polyester resin, resulting in improvement of low-temperature fixability.

Specifically, the alcohol that includes ethylene glycol as a main component accelerates rapid melting of the ester compound. Accordingly, the binder resin is also melted rapidly when being fixed, providing improved low-temperature fixability.

Moreover, the fatty acid that includes stearic acid and behenic acid as main components also accelerates rapid melting of the ester compound because the fatty acid improves crystallinity of the ester compound. Accordingly, the binder resin is also melted rapidly when being fixed, providing improved low-temperature fixability.

Specific examples of suitable alcohols other than ethylene glycol include, but are not limited to, polyols such as propylene glycol, butylene glycol, tetramethylene glycol, and glycerin; and condensation products of the polyols. The condensation products preferably have a polymerization degree of 2 to 20, more preferably 4 to 18, and much more preferably 6 to 16. When the polymerization degree is too large, crystallinity of the resultant ester compound may decrease, thereby suppressing rapid melting of the ester compound. As a result, low-temperature fixability of the resultant toner may decrease as well.

Specific examples of suitable fatty acids other than stearic acid and behenic acid include, but are not limited to, fatty acids having 12 to 24, preferably 16 to 20, carbon atoms such as lauric acid, palmitic acid, arachidic acid, eicosanoic acid, and lignoceric acid; and mixtures thereof. When the number of carbon atoms is too small, crystallinity of the resultant ester compound may decrease, resulting in low melting point. As a consequence, heat-resistant storage stability of the resultant toner may deteriorate. In addition, the decreased crystallinity also suppresses rapid melting of the ester compound, resulting in poor low-temperature fixability.

The ester compound preferably has a hydroxyl value of 10 to 100 mgKOH/g, more preferably 30 to 80 mgKOH/g, and much more preferably 40 to 60 mgKOH/g, for effectively accelerating softening of the polyester resin. When the hydroxyl value is too small, such an ester compound may have insufficient compatibility with the polyester resin, resulting in poor low-temperature fixability. By contrast, when the hydroxyl value is too large, chargeability of the resultant toner may deteriorate at high-temperature and high-humidity conditions.

The hydroxyl value is defined as the amount (mg) of potassium hydroxide (KOH) needed to neutralize acetic acid bound to hydroxyl groups in 1 g of a sample which is acetylated by a method described below.

First, about 1 g of a sample is precisely weighed and contained in a round-bottom flask. Next, 5 ml of an acetic anhydride-pyridine test solution are precisely measured and added to the flask. A small funnel is put on an opening of the flask and the flask is heated for 1 hour in an oil bath at 95 to 100° C., while immersing the bottom of the flask therein for a depth of about 1 cm. Subsequently, the flask is cooled and 1 ml of water is added thereto. The flask is well shaken and further heated for 10 minutes. The flask is cooled again and the small funnel and the neck of the flask are washed with 5 ml of ethanol. Further, 1 ml of a phenolphthalein test solution is added the flask as an indicator. An excessive amount of acetic acid is titrated with a 0.5 mol/l potassium hydroxide ethanol solution (i.e., a main test).

A blank test is performed in the same manner as described above except that no sample is contained in the flask. The hydroxyl value is calculated from the following equation:

$$OHV=((a-b)\times 28.05)/W+AV$$

wherein OHV (mgKOH/g) represents a hydroxyl value; AV (mgKOH/g) represents an acid value; a and b (ml) each represent amounts of the 0.5 mol/l potassium hydroxide ethanol solution needed for the titrations in the main test and the blank test, respectively; and W (g) represents an amount of the sample.

The acid value is defined as the amount (mg) of potassium hydroxide (KOH) needed to neutralize 1 g of a sample. The acid value is measured as follows.

First, about 1.0 g of a sample is precisely weighed and dissolved in 50 ml of an ethanol-ether mixture liquid, in which ethanol and ether are mixed in a volume ratio of 1:1, while applying heat, if needed. The sample solution thus prepared is cooled and several drops of a phenolphthalein test solution are added thereto. The sample solution is then titrated with a 0.1 mol/l potassium hydroxide ethanol solution until continuously expressing pink color for 30 seconds. The acid value is calculated from the following equation:

$$AV=c\times 5.611/W$$

wherein AV (mgKOH/g) represents an acid value; c (ml) represents an amount of the 0.1 mol/l potassium hydroxide ethanol solution needed for the titration; and W (g) represents an amount of the sample.

The ester compound has a melting point of 60 to 85° C. When the melting point is too low, the resultant toner may have poor heat-resistant storage stability. By contrast, when the melting point is too large, the resultant toner may have poor low-temperature fixability. The meting point is defined as a temperature at which the maximum peak is observed in a differential curve obtained by differential scanning calorimetry (DSC).

The toner of the present invention preferably includes the ester compound serving as the fixing auxiliary component in an amount of 3 to 20% by weight, and preferably 5 to 18% by weight. When the amount is too small, the resultant toner may have poor hot offset resistance. When the amount is too large, the resultant toner may have poor fluidity and chargeability.

The amount W of the ester compound included in a toner can be measured by DSC as well as the meting point as follows. First, the ester compound alone is subjected to DSC so as to measure the heat of melting Qw (J/mg) per unit weight thereof. Next, the toner is subjected to DSC in the same manner so as to measure the heat of melting Qt (J/mg) of the ester compound included in unit weight of the toner. The amount of the ester compound W included in the toner is calculated by the following equation:

$$W=Qt/Qw\times 100(\%\text{ by weight})$$

The fixing auxiliary component exists in the toner forming crystalline domains thereof and melts upon application of heat so as to be compatible with the binder resin.

Whether or not the fixing auxiliary component expresses crystallinity in the toner can be determined using an X-ray diffractometer such as X'Pert MRD from Philips by a method described below.

First, the fixing auxiliary component alone is ground in a mortar. The specimen of the fixing auxiliary component thus obtained is evenly applied on a specimen holder and the specimen holder is then set to the X-ray diffractometer to obtain a diffraction spectrum of the fixing auxiliary component. Next, the toner is applied on a specimen holder so that a diffraction spectrum of the toner is obtained in the same way. By comparing the diffraction spectra of the fixing auxiliary component alone and the toner, the fixing auxiliary component included in the toner can be identified.

Since a heating unit is attached to the X-ray diffractometer, it is possible to measure changes in diffraction spectrum along with changes in temperature. For example, a change in peak area specific to the fixing auxiliary component in X-ray diffraction spectrum from room temperature to 150° C. can be measured. In this case, a change in amount of the fixing auxiliary component which is compatible and/or incompatible with the binder resin before and after heat is applied can be determined. The greater the change, the greater the amount of compatible components which generate upon application of heat. This means that heat facilitates the fixing auxiliary component's compatibility with the binder resin. As a result, excellent low-temperature fixability is provided.

Each of the domains of the fixing auxiliary component in the toner preferably has a longest diameter of 10 nm to 3 μm, more preferably 50 nm to 1 μm, and much more preferably 70 nm to 500 nm. When the longest diameter is too short, the contact area of the fixing auxiliary component with the binder resin may be too large, resulting in poor heat-resistance storage stability. When the longest diameter is too long, the fixing auxiliary component may be incompatible with the binder resin even upon application of heat, resulting in poor low-temperature fixability.

The diameter of domains of the fixing auxiliary component can be measured as follows, for example. A toner is embedded in an epoxy resin and cut into an ultra-thin section having a thickness of about 100 nm. The ultra-thin section is then dyed with ruthenium tetroxide. The dyed ultra-thin section is observed by transmission electron microscope (TEM) at a magnification of 10,000 times and photographed. The diameter of domains is measured from the photograph.

It is to be noted that the reason for the dyeing of the ultra-thin section is to make contrasts between the fixing auxiliary component, the binder resin, and the release agent in the photograph so that they are easily distinguished.

In the present invention, the following equation is preferably satisfied:

$$Tgr-Tgr'\geqq 10^\circ\text{ C.}$$

wherein Tgr represents a glass transition temperature of the polyester resin and Tgr' is a glass transition temperature of a mixture of 90 parts by weight of the polyester resin with 10 parts by weight of the fixing auxiliary component that is heated to 150° C. More preferably, Tgr−Tgr'≧15° C. is satisfied, and much more preferably, Tgr−Tgr'≧18° C. is satisfied. When Tgr−Tgr'≧10° C. is satisfied, it means that the fixing auxiliary component more effectively softens the polyester resin, thereby providing much better low-temperature fixability.

Tgr and Tgr' can be measured using a differential scanning calorimetry system such as DSC-60 from Shimadzu Corporation.

With regard to measurement of Tgr, first, about 5.0 mg of the polyester resin is contained in an aluminum specimen container. The specimen container is then loaded on a holder unit and set in an electric furnace. The specimen is heated from 20° C. to 150° C. at a heating rate of 10° C./min under nitrogen atmosphere, and subsequently cooled from 15° C. to 0° C. at a cooling rate of 10° C./min. The specimen is further heated to 150° C. at a heating rate of 10° C./min, while a DSC curve is measured. The DSC curve is analyzed by analysis software of the DSC-60 so as to calculate Tgr. More specifically, Tgr is calculated from a shoulder in the DSC curve that is obtained in the second heating.

Tgr' is measured by the same method as described above except that 0.5 mg of the fixing auxiliary component and 4.5 mg of the polyester resin is contained in the aluminum specimen container.

The binder resin includes a polyester resin because of its low-temperature fixability, as described above. The polyester resin is not limited to have any particular molecular weight, composition, etc. The binder resin may include other resins other than the polyester resin. Specific examples of usable resins other than the polyester resin include, but are not limited to, homopolymers and copolymers of styrene monomers, acrylic monomers, and methacrylic monomers; polyol resins, phenol resins, silicone resins, polyurethane resins, polyamide resins, furan resins, epoxy resins, xylene resins, terpene resins, coumarone-indene resins, polycarbonate resins, and petroleum resins. These resins can be used alone or in combination.

The polyester resin is formed from dehydration condensation between a polyol and a polycarboxylic acid. Specific examples of suitable polyols include, but are not limited to, ethylene glycol, propylene glycol, 1,3-butanediol, 1,4-butanediol, 2,3-butanediol, diethyleneglycol, triethylene glycol, 1,5-pentanediol, 1,6-hexanediol, neopentyl glycol, 2-ethyl-1,3-hexanediol, hydrogenated bisphenol A, and divalent alcohols formed by adducting a cyclic ether such as ethylene oxide and propylene oxide to bisphenol A. In order that the polyester resin cross-links, alcohols having 3 or more valences are preferably used in combination, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Specific examples of suitable polycarboxylic acids include, but are not limited to, benzene dicarboxylic acids such as phthalic acid, isophthalic acid, and terephthalic acid, and anhydrides thereof; alkyl dicarboxylic acids such as succinic acid, adipic acid, sebacic acid, and azelaic acid, and anhydrides thereof; unsaturated dibasic acids such as maleic acid, citraconic acid, itaconic acid, alkenyl succinic acid, fumaric acid, and mesaconic acid, and anhydrides thereof; and trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetrakis(methylenecarboxy)methane, and 1,2,7,8-octanetetracarboxylic acid, and anhydrides and partial lower alkyl esters thereof.

The polyester resin preferably has an acid value of 5 to 40 mgKOH/g, and more preferably 10 to 30 mgKOH/g, and much more preferably 15 to 25 mgKOH/g. When the acid value is too small, compatibility with paper that is a principal recording medium may deteriorate, resulting in poor low-temperature fixability of the resultant toner. Further, such a polyester resin may be difficult to be charged negatively, resulting in deterioration of the resultant image quality. Moreover, such a polyester resin may have poor compatibility with the fixing auxiliary component, thereby degrading low-temperature fixability of the resultant toner. By contrast, when the acid vale is too large, the resultant image quality may deteriorate under high-temperature and high-humidity conditions and low-temperature and low-humidity conditions.

The polyester resin preferably has a hydroxyl value of 5 to 100 mgKOH/g, and more preferably 20 to 60 mgKOH/g. When the hydroxyl value is too small, compatibility with paper that is a principal recording medium may deteriorate, resulting in poor low-temperature fixability of the resultant toner. Further, such a polyester resin may be difficult to be charged negatively, resulting in deterioration of the resultant image quality. Moreover, such a polyester resin may have poor compatibility with the fixing auxiliary component, thereby degrading low-temperature fixability of the resultant toner. By contrast, when the hydroxyl vale is too large, the resultant image quality may deteriorate under high-temperature and high-humidity conditions and low-temperature and low-humidity conditions.

From the viewpoint of improvement of fixability and hot offset resistance of the toner, THF-soluble components in the polyester resin preferably have a molecular weight distribution such that at least one peak exists within a molecular weight range of 3000 to 50000, more preferably 5000 to 20000, and much more preferably 7000 to 10000. Further, the THF-soluble components in the polyester resin preferably include components having a molecular weight of 100000 or less in an amount of 60 to 100% by weight, and more preferably 70 to 90% by weight. The molecular weight distribution of the polyester resin can be measured by gel permeation chromatography (GPC) using THF as a solvent.

From the viewpoint of improvement of storage stability of the toner, the polyester resin preferably has a glass transition temperature (Tg) of 55 to 80° C., more preferably 60 to 75° C., and much more preferably 65 to 70° C. Such a polyester resin has excellent storage stability even at high temperatures and is effectively softened by the fixing auxiliary component.

The release agent preferably has a melting point of 60 to 90° C., which is relatively low. Such a low-melting-point release agent effectively functions between a fixing roller and a toner image so that the toner image does not cause hot offset even when an oil is not applied to the fixing roller. In particular, the fixing roller may be set to a lower temperature than usual because the toner of the present invention has better low-temperature fixability due to introduction of the fixing auxiliary component. Therefore, the release agent is required to express its releasing ability at lower temperatures. Accordingly, the release agent preferably has a melting point of 90° C. or less, more preferably 85° C. or less, and much more preferably 80° C. or less. When the melting point is too small, heat-resistant storage stability of the toner may deteriorate.

Specific examples of usable release agents include, but are not limited to, natural waxes such as plant waxes (e.g., carnauba wax, cotton wax, vegetable wax, rice wax), animal waxes (e.g., bees wax, lanoline), mineral waxes (e.g., ozokerite, ceresin), and petroleum waxes (e.g., paraffin, microcrystalline, petrolatum); synthesized hydrocarbon waxes such as Fischer-Tropsch wax, polyethylene wax, and polypropylene wax; synthesized waxes such as esters, ketones, and ethers; fatty acid amides such as 12-hydroxystearic acid amide, stearic acid amide, phthalic anhydride imide, and chlorinated hydrocarbons; homopolymers and copolymers of low-molecular-weight crystalline polymer resins such as poly-n-stearyl methacrylate and poly-n-lauryl methacrylate (e.g., n-stearyl acrylate-ethyl methacrylate copolymer); and crystalline polymers having a long side chain. These release agents can be used alone or in combination.

Among the above-described release agents, hydrocarbon waxes such as paraffin, polyethylene, and polypropylene are preferable, because the hydrocarbon waxes have low compatibility with the ester compound that serves as the fixing auxiliary component. In other words, the release agent and the fixing auxiliary component express their functions separately without disturbing with each other.

Specific examples of colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmiumred, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These materials can be used alone or in combination.

The toner preferably includes the colorant in an amount of from 1 to 15% by weight, and more preferably from 3 to 10% by weight. When the amount is too small, coloring power of the resultant toner may deteriorate. When the amount is too large, the colorant may not be well dispersed in the resultant toner, resulting in deterioration of coloring power and electric properties of the toner.

The colorant for use in the present invention can be combined with a resin to be used as a master batch. Specific examples of the resin for use in the master batch include, but are not limited to, polyester, polymers of styrenes or substitutions thereof, styrene copolymers, polymethyl methacrylate, polybutyl methacrylate, polyvinyl chloride, polyvinyl acetate, polyethylene, polypropylene, epoxy resins, epoxy polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffin, and paraffin wax. These resins can be used alone or in combination.

Specific examples of the polymers of styrenes or substitutions thereof include, but are not limited to, polystyrene, poly(p-chlorostyrene), and polyvinyl toluene. Specific examples of the styrene copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The toner of the present invention may further include a charge controlling agent, a particulate inorganic material, a cleanability improving agent, a magnetic material, and the like.

Specific examples of usable charge controlling agents include, but are not limited to, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surfactants, metal salts of salicylic acid, and metal salts of salicylic acid derivatives. These materials can be used alone or in combination.

Specific examples of commercially available charge controlling agents include, but are not limited to, BONTRON® N-03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as sulfonate group, carboxyl group, and a quaternary ammonium group.

The toner preferably includes the charge controlling agent in an amount of from 0.1 to 10% by weight, preferably from 0.2 to 5% by weight, and more preferably from 0.3 to 3% by weight, per 100 parts by weight of the binder resin. When the amount is too small, charge of the resultant toner maybe uncontrollable. When the amount is too large, the toner has too large a charge quantity, thereby increasing electrostatic attracting force between a developing roller. Consequently, fluidity of the resultant toner and image density of the resultant image may deteriorate.

The particulate inorganic material serves as an external additive that imparts fluidity, developability, and chargeability to the resultant toner. Specific examples of usable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These materials can be used alone or in combination.

The particulate inorganic material preferably has a primary particle diameter of from 5 nm to 2 μm, more preferably from 5 to 500 nm, and much more preferably from 10 to 300 nm.

The toner preferably includes the particulate inorganic material in an amount of from 0.01 to 5.0% by weight, and more preferably from 0.01 to 2.0% by weight, and much more preferably from 0.05 to 1.0% by weight.

The particulate inorganic material is preferably surface-treated with a fluidity improving agent so that hydrophobicity of the particulate inorganic material is improved. As a result, deterioration of fluidity and/or chargeability of the resultant toner is prevented even in high-humidity conditions. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. In particular, silica and titanium oxide are preferably surface-treated with a fluidity improving agent so as to be used as a hydrophobized silica and a hydrophobized titanium oxide, respectively.

The cleanability improving agent is added to the toner so that toner particles remaining on a photoreceptor or a primary transfer medium without being transferred onto a recording medium or the like are easily removed. Specific examples of the cleanability improving agents include, but are not limited to, metal salts of aliphatic acids such as zinc stearate and calcium stearate; and fine particles of polymers which are manufactured by a soap-free emulsion polymerization method, such as polymethyl methacrylate and polystyrene. The fine particles of a polymer preferably have a narrow particle diameter distribution, and a volume average particle diameter of from 0.01 to 1 μm, more preferably from 0.03 to 0.8 μm, and much more preferably from 0.05 to 0.6 μm.

Specific examples of usable magnetic materials include, but are not limited to, iron powders, magnetite, and ferrite. In consideration of the color tone of the resultant toner, whitish magnetic materials are preferably used.

The toner of the present invention has both low-temperature fixability and hot offset resistance, and is capable of consistently producing high quality images. Such a toner of the present invention is preferably used for electrophotography.

The toner of the present invention is obtainable by any known methods such as pulverization methods, polymerization methods, dissolution suspension methods, and spray granulation methods. Among these methods, polymerization methods are preferable.

A pulverization method is a method in which toner components including a colorant, a binder resin, a release agent, and a fixing auxiliary component are melt-kneaded in a process called melt-kneading, the melt-kneaded mixture is pulverized in a process called pulverization, and the pulverized mixture is classified in a process called classification, so that mother toner particles are produced.

In the melt-kneading process, toner components are mixed and the mixture is melt-kneaded by a melt-kneader, such as a single-axis or double-axis continuous kneader and a batch kneader using roll mill. Specific examples of commercially available kneaders include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., and KOKNEADER from Buss Corporation. The melt-kneading process is performed such that molecular chains of the binder resin are not cut. In particular, the melt-kneading temperature is determined considering the softening point of the binder resin. When the melt-kneading temperature is too much higher than the softening point of the binder resin, the molecular chains are cut. When the melt-kneading temperature is too much lower than the softening point of the binder resin, the toner components cannot be well dispersed.

In the pulverization process, the kneaded mixture is pulverized. The kneaded mixture is preferably subjected to coarse pulverization at first, followed by fine pulverization. Suitable pulverization methods include a method in which the particles collide with a collision board in a jet stream; a method in which the particles collide with each other in a jet mill; a method in which the particles are pulverized in a narrow gap formed between a mechanically rotating rotor and a stator; etc.

In the classification process, the pulverized particles are classified so that particles having a desired particle size are collected. For example, fine particles having undesired particle size are removed using cyclone, decanter, or a centrifugal separator.

The classified particles may be further subjected to another classification in airflow. Thus, a mother toner is obtained.

The mother toner is then mixed with an external additive using a mixer so that the external additives are pulverized into fine particles and adhere to the surfaces of the mother toner particles. It is important that the external additive such as a particulate inorganic material and a particulate resin is adhered to the mother toner particles as evenly and strongly as possible, from the viewpoint of durability.

Specific preferred examples of the polymerization method include, but are not limited to, a dissolution suspension polymerization method in which toner components including a modified polyester resin capable of forming urea or urethane bond, a release agent, a colorant, and a fixing auxiliary component are dissolved or dispersed in a solvent, the resultant solution or dispersion is dispersed in an aqueous medium so that the modified polyester resin is subjected to polyaddition, and the solvent is removed from the dispersion.

Specific examples of the modified polyester resin capable of forming urea or urethane bond include, but are not limited to, a polyester prepolymer having an isocyanate group which is formed by reacting carboxyl or hydroxyl group on an end of a polyester with a polyisocyanate compound (PIC). When such a polyester prepolymer reacts with an amine, molecular chains thereof cross-link or elongate, resulting in formation of a modified polyester resin. The modified resin thus formed has either low-temperature fixability or hot offset resistance.

Specific examples of the polyisocyanate compound (PIC) include, but are not limited to, aliphatic polyisocyanates such as tetramethylene diisocyanate, hexamethylene diisocyanate, and 2,6-diisocyanatomethyl caproate; alicyclic polyisocyanates such as isophorone diisocyanate and cyclohexylmethane diisocyanate; aromatic diisocyanates such as tolylene diisocyanate and diphenylmethane diisocyanate; aromatic aliphatic diisocyanates such as α,α,α',α'-tetramethylxylylene diisocyanate; isocyanurates; and the above-described polyisocyanates blocked with a phenol derivative, an oxime, or a caprolactam. These compounds can be used alone or in combination.

The equivalent ratio ([NCO]/[OH]) of isocyanate groups in the polyisocyanate compound (PIC) to hydroxyl groups in the polyester is preferably 5/1 to 1/1, more preferably 4/1 to 1.2/1, and much more preferably 2.5/1 to 1.5/1.

The number of isocyanate groups included in the polyester prepolymer (A) having an isocyanate group is preferably 1 or more per molecule and in an average number of 1.5 to 3, and more preferably in an average number of 1.8 to 2.5.

Specific examples of the amine (B) to be reacted with the polyester prepolymer (A) include, but are not limited to, diamine compounds (B1), polyamine compounds (B2) having 3 or more valences, amino alcohols (B3), amino mercaptans (B4), amino acids (B5), and blocked amines (B6) in which the amino groups in the amines (B1) to (B5) are blocked.

Specific examples of the diamine compounds (B1) include, but are not limited to, aromatic diamines such as phenylene diamine, diethyltoluene diamine, and 4,4'-diamino diphenylmethane; alicyclic diamines such as 4,4'-diamino-3,3'-dimethyldicyclohexylmethane, diamine cyclohexane, and isophorone diamine; and aliphatic diamines such as ethylene diamine, tetramethylene diamine, and hexamethylene diamine.

Specific examples of the polyamine compounds (B2) having 3 or more valences include, but are not limited to, diethylene triamine and triethylene tetramine.

Specific examples of the amino alcohols (B3) include, but are not limited to, ethanolamine and hydroxyethyl aniline.

Specific examples of the amino mercaptans (B4) include, but are not limited to, aminoethyl mercaptan and aminopropyl mercaptan.

Specific examples of the amino acids (B5) include, but are not limited to, amino propionic acid and amino caproic acid.

Specific examples of the blocked amines (B6) in which the amino groups in the amines (B1) to (B5) are blocked include, but are not limited to, ketimine compounds obtained from the amines (B1) to (B5) and ketones (e.g., acetone, methyl ethyl ketone, methyl isobutyl ketone) and oxazoline compounds.

Among these amines (B), (B1) alone and a mixture of (B1) with a small amount of (B2) are preferable.

The equivalent ratio ([NCO]/[NHx]) of isocyanate groups in the polyester prepolymer (A) to amino groups in the amine (B) is preferably 1/2 to 2/1, more preferably 1.5/1 to 1/1.5, and much more preferably 1.2/1 to 1/1.2.

The above-described polymerization method is capable of producing small-sized spherical toner with less environmental load and low cost.

A developer of the present invention comprises the toner described above, and other components such as a carrier, if desired. The developer may be either a one-component developer consisting essentially of the toner or a two-component developer including the toner and a carrier. In accordance with recent improvement of information processing speed of printers, two-component developers are preferably used from the viewpoint of the developer's lifespan. The developer of the present invention is usable for any known electrophotographic developing methods such as a magnetic one-component developing method, a non-magnetic one-component developing method, and a two-component developing method.

When the toner is used for a one-component developer, the average particle diameter of the toner does not vary significantly, even when consumption and supply of toner particles are repeated. Further, the toner is unlikely to form an undesirable toner film on a developing roller or adheres to a blade configured to form a thin toner layer. Accordingly, the toner has consistent developability even after being agitated in a developing device.

When the toner is used in a two-component developer, the average particle diameter of the toner does not vary significantly, even when consumption and supply of toner particles are repeated. Accordingly, the toner has consistent developability even after being agitated in a developing device.

The two-component developer preferably includes a carrier in an amount of from 90 to 98% by weight, more preferably from 93 to 97% by weight, and much more preferably from 94 to 96% by weight.

The carrier preferably includes a core and a resin layer covering the core.

Specific preferred examples of usable materials for the core include, but are not limited to, manganese-strontium (Mn—Sr) and manganese-magnesium (Mn—Mg) materials having a magnetization of from 50 to 90 emu/g. These materials can be used alone or in combination. In order to obtain high image density, high-magnetization materials such as iron powders having a magnetization of 100 emu/g or more and magnetites having a magnetization of from 75 to 120 emu/g are preferably used. In order to produce high quality images, low-magnetization materials such as copper-zinc (Cu—Zn) materials having a magnetization of from 30 to 80 emu/g are preferably used, because a magnetic brush thereof may weakly contact a photoreceptor.

The core preferably has a volume average particle diameter (D50) of from 10 to 150 μm, and more preferably from 20 to 80 μm. When the volume average particle diameter is too small, the carrier excessively includes fine particles, thereby reducing magnetization per molecule. Consequently, carrier particles may scatter. When the volume average particle diameter is too large, the carrier has a low specific area. Consequently, insufficiently-charged toner particles may scatter, or a solid image portion may not be reliably reproduced.

Specific preferred examples of usable resins for the resin layer include, but are not limited to, amino resins, polyvinyl resins, polystyrene resins, halogenated olefin resins, polyester resins, polycarbonate resins, polyethylene resins, polyvinyl chloride resins, polyvinylidene chloride resins, polytetrafluoroethylene resins, polyhexafluoropropylene resins, copolymers of vinylidene fluoride and an acrylic monomer, copolymers of vinylidene fluoride and vinyl fluoride, terpolymers of tetrafluoroethylene, vinylidene fluoride, and a non-fluorinated monomer, and silicone resins. These resins can be used alone or in combination.

Specific examples of the amino resins include, but are not limited to, urea-formamide resins, melamine resins, benzoguanamine resins, urea resins, polyamide resins, and epoxy resins. Specific examples of the polyvinyl resins include, but are not limited to, acrylic resins, polymethyl methacrylate resins, polyacrylonitrile resins, polyvinyl acetate resins, polyvinyl alcohol resins, and polyvinyl butyral resins. Specific examples of the polystyrene resins include, but are not limited to, polystyrene resins and styrene-acrylic copolymer resins. Specific examples of the halogenated olefin resins include, but are not limited to, polyvinyl chloride. Specific examples of the polyester resins include, but are not limited to, polyethylene terephthalate resins and polybutylene terephthalate resins.

The resin layer may include a conductive powder, if desired. Specific examples of usable conductive powders include, but are not limited to, powders of metals, carbon black, titanium oxide, tin oxide, and zinc oxide. The conductive powder preferably has an average particle diameter of 1 μm or less. When the average particle diameter is too large, electric resistance thereof may be difficult to control.

The resin layer can be formed by, for example, dissolving a silicone resin, etc., in an organic solvent to prepare a cover layer coating liquid, and evenly applying the cover layer coating liquid on the core by known methods such as a dip coating method, a spray coating method, and a brush coating method. The coated core is then subjected to drying and baking. Specific examples of the organic solvents include, but are not limited to, toluene, xylene, methyl ethyl ketone, methyl isobutyl ketone, and cellosolve butyl acetate. The baking method can be either or both of an external heating method or an internal heating method. Specific baking methods include methods using a fixed electric furnace, a portable electric furnace, a rotary electric furnace, a burner furnace, and a microwave, but are not limited thereto.

The carrier preferably includes the cover layer in an amount of from 0.01 to 5.0% by weight. When the amount is too small, a uniform resin layer may not be formed on the surface of the core. When the amount is too large, the resin layer may have too large of a thickness, thereby causing aggregating of carrier particles.

The developer of the present invention is applicable to any known electrophotographic developing methods such as a magnetic one-component developing method, a non-magnetic one-component developing method, and a two-component developing method.

The toner or developer of the present invention may be contained in a container. That is, toner containers according to the present invention may include a case portion suitable for storing and dispensing toner and toner provided in the case portion. Suitable toner containers may include a main body and a cap.

The container is not limited in size, shape, structure, material, and the like. The container preferably has a cylindrical shape having spiral projections and depressions on the inner surface thereof. Such a container can feed the toner or developer to an ejection opening by rotation. It is more preferable that a part or all of the spiral parts of such a container have a structure like an accordion. Suitable materials used for the container include materials having good dimensional accuracy. In particular, resins are preferably used. Specific preferred examples of usable resins for the container include, but are not limited to, polyester resins, polyethylene resins, polypropylene resins, polystyrene resins, polyvinylchloride resins, polyacrylic acids, polycarbonate resins, ABS resins, and polyacetal resins.

The container is preferably easily preservable, transportable, and treatable. Further, the container is preferably detachable from a process cartridge and an image forming apparatus to feed the toner or developer thereto.

An image forming method of to the present invention includes an electrostatic latent image forming process, a developing process, a transfer process, and a fixing process, preferably a cleaning process, and optionally a decharge process, a recycle process, a control process, and the like.

The image forming method of the present invention may be performed by an image forming apparatus of the present invention including an electrostatic latent image bearing member, an electrostatic latent image forming device, a developing device, a transfer device, and a fixing device, preferably a cleaning device, and optionally a decharge device, a recycle device, a control device, and the like.

In the electrostatic latent image forming process, an electrostatic latent image is formed on an electrostatic latent image bearing member such as a photoconductive insulator and a photoreceptor.

The material, shape, structure, and size of the electrostatic latent image bearing member are not particularly limited, however, a drum-shaped electrostatic latent image bearing member is preferably used. Specific examples of usable photoreceptors include, but are not limited to, inorganic photoreceptors including amorphous silicon, selenium, etc., and organic photoreceptors including polysilane, phthalopolymethine, etc. Among these photoreceptors, inorganic photoreceptors including amorphous silicon is preferably used in terms of long life of the electrostatic latent image bearing member.

The electrostatic latent image forming device forms an electrostatic latent image by uniformly charging the surface of the electrostatic latent image bearing member, and subsequently irradiating the charged surface of the electrostatic latent image bearing member with a light beam containing image information, for example. The electrostatic latent image forming device includes a charger to uniformly charge the surface of the electrostatic latent image bearing member and an irradiator to irradiate the charged surface of the electrostatic latent image bearing member with a light beam containing image information, for example.

As the charger, for example, any known contact chargers including a conductive or semi-conductive roller, brush, film, and rubber blade, or the like, and any known non-contact chargers using corona discharge such as corotron and scorotron can be used.

Any known irradiators capable of irradiating the charged surface of the electrostatic latent image bearing member can be used, so long as a latent image is formed thereon. For example, irradiators using a radiation optical system, a rod lens array, a laser optical system, a liquid crystal shutter optical system, an LED optical system, etc., can be used. In the present invention, the electrostatic latent image bearing member may be irradiated with a light beam containing image information from the backside thereof.

In the developing process, the electrostatic latent image is developed with the developer of the present invention to form a toner image. The developing device forms the toner image by developing the electrostatic latent image with the developer of the present invention. Any known developing devices capable of developing the electrostatic latent image with the developer of the present invention can be used. For example, a developing device containing the developer of the present invention, preferably contained in the above-described container, and capable of supplying the toner to the electrostatic latent image by either being in or out of contact therewith can be used. The developing device may be either a single-color or a multi-color developing device. The developing device preferably includes an agitator to agitate the developer so as to triboelectrically charge the developer, and a rotatable magnetic roller, for example. In the developing device, for example, the toner and the carrier are mixed so that the toner is charged. The developer (e.g., the toner and the carrier) forms magnetic brushes on the surface of the rotatable magnetic roller. Since the magnetic roller is provided adjacent to the electrostatic latent image bearing member, apart of the toner that forms the magnetic brushes on the magnetic roller is moved to the surface of the electrostatic latent image bearing member due to an electric attraction force. As a result, the electrostatic latent image is developed with the toner and a toner image is formed on the surface of the electrostatic latent image bearing member. The developer may also be a combination of both a one-component developer and a two-component developer.

In the transfer process, a toner image is transferred onto a recording medium. The transfer process is performed by, for example, charging a toner image formed on the electrostatic latent image bearing member by the transfer device such as a transfer charger. It is preferable that the transfer process includes a primary transfer process in which a toner image is transferred onto an intermediate transfer member and a secondary transfer process in which the toner image is transferred from the intermediate transfer member onto a recording medium. It is more preferable that the transfer process includes a primary transfer process in which two or more monochrome toner images, preferably in full color, are transferred onto the intermediate transfer member to form a composite toner image and a secondary transfer process in which the composite toner image is transferred onto the recording medium.

The transfer device preferably includes a primary transfer device to transfer monochrome toner images onto an intermediate transfer member to form a composite toner image and a secondary transfer device to transfer the composite toner image onto a recording medium. Any known transfer members can be used as the intermediate transfer member. For example, a transfer belt is preferably used. The transfer device (such as the primary transfer device and the secondary transfer device) preferably includes a transferrer to separate the toner image from the electrostatic latent image bearing member onto the recording medium. The transfer device may be used alone or in combination.

As the transferrer, a corona transferrer using corona discharge, a transfer belt, a transfer roller, a pressing transfer roller, an adhesion transferrer, etc., can be used.

As the recording medium, any known recording media such as a recording paper can be used.

In the fixing process, the toner image transferred onto a recording medium is fixed thereon by the fixing device. Each monochrome toner image may be independently fixed on the recording medium. Alternatively, a composite toner image in which monochrome toner images are superimposed on one another may be fixed at once. As the fixing device, any known heat and pressure applying devices are preferably used. As the heat and pressure applying device, a combination of a heating roller and a pressing roller, a combination of a heating roller, a pressing roller, and a seamless belt, etc., can be used. A heating target is typically heated to a temperature of from 80 to 200° C. Any known optical fixing devices may be used alone or in combination with the above-described fixing device in the fixing process.

In the decharge process, charges remaining on the electrostatic latent image bearing member are removed by applying a decharge bias to the electrostatic latent image bearing member. The decharge process is preferably performed by a decharge device. As the decharge device, any known dechargers capable of applying a decharge bias to the electrostatic latent image bearing member can be used. For example, a decharge lamp is preferably used.

In the cleaning process, toner particles remaining on the electrostatic latent image bearing member are removed by a cleaning device. As the cleaning device, any known cleaners capable of removing toner particles remaining on the electrostatic latent image bearing member can be used. For example, a magnetic brush cleaner, an electrostatic brush cleaner, a magnetic roller cleaner, a blade cleaner, a brush cleaner, a web cleaner, etc. can be used.

In the recycle process, the toner particles removed in the cleaning process are recycled by a recycle device. As the recycle device, any known feeding devices can be used, for example.

In the control process, each of the processes is controlled by a control device. As the control device, a sequencer, a computer, etc. can be used.

FIG. 1 is a schematic view illustrating an embodiment of an image forming apparatus of the present invention. An image forming apparatus 100A illustrated in FIG. 1 includes a photoreceptor 10 serving as the electrostatic latent image bearing member, a charging roller 20 serving as the charger, a light irradiator 30 serving as the irradiator, developing units 45K, 45Y, 45M, and 45C each serving as the developing device, an intermediate transfer medium 50, a cleaning device 59 including a cleaning blade serving as the cleaning device, and a decharging lamp 64 serving as the discharging device.

The intermediate transfer medium 50 is an endless belt. The intermediate transfer medium 50 is stretched taut by three rollers 51 to move endlessly in a direction indicated by an arrow in FIG. 1. Some of the rollers 51 have a function of applying a transfer bias to the intermediate transfer medium 50 in the primary transfer process.

A cleaning device 90 including a cleaning blade is provided close to the intermediate transfer medium 50. A transfer roller 62 serving as the transfer device is provided facing the intermediate transfer medium 50. The transfer roller 62 is capable of applying a transfer bias to transfer a toner image onto a transfer paper 95 in the secondary transfer process.

A corona charger 52 configured to charge the toner image on the intermediate transfer medium 50 is provided on a downstream side from a contact point of the intermediate transfer medium 50 with the photoreceptor 10, and a upstream side from a contact point of the intermediate transfer medium 50 with the transfer paper 95, relative to the direction of rotation of the intermediate transfer medium 50.

The developing units 45K, 45Y, 45M, and 45C include developer containers 42K, 42Y, 42M, and 42C, developer feeding rollers 43K, 43Y, 43M, and 43C, and developing rollers 44K, 44Y, 44M, and 44C, respectively.

In the image forming apparatus 100A, the photoreceptor 10 is evenly charged by the charging roller 20, and subsequently the light irradiator 30 irradiates the photoreceptor 10 with a light beam containing image information to form an electrostatic latent image thereon. The electrostatic latent image formed on the photoreceptor 10 is developed with toners supplied from the developing units 45K, 45Y, 45M, and 45C, to form a toner image. The toner image is transferred onto the intermediate transfer medium 50 due to a bias applied to some of the rollers 51 (i.e., the primary transfer process), and subsequently transferred onto the transfer paper 95 (i.e., the secondary transfer process) by the corona charger 52. Toner particles remaining on the photoreceptor 10 are removed by the cleaning device 59, and the photoreceptor 10 is decharged by the decharging lamp 64.

Figure 2:
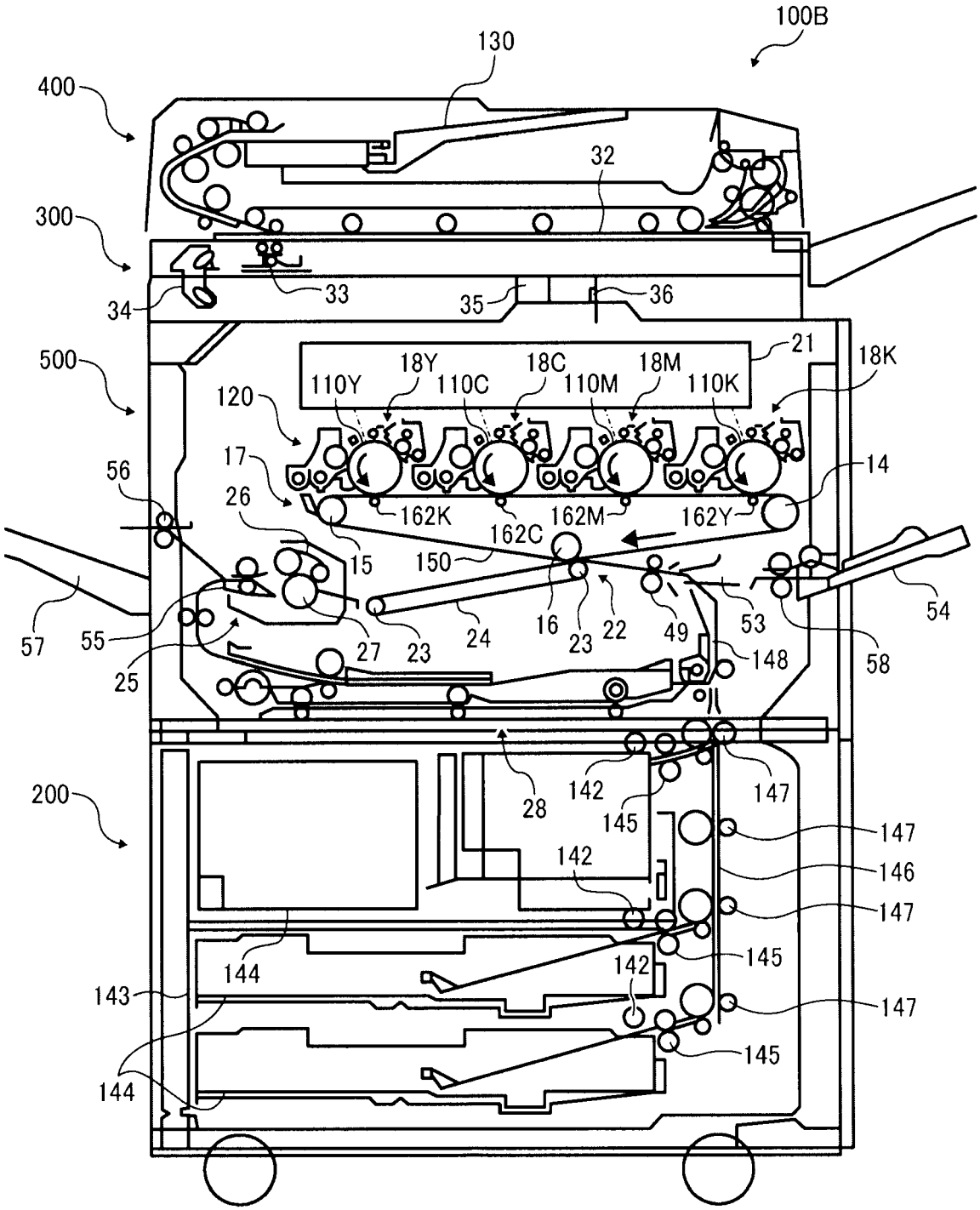
FIG. 2 is a schematic view illustrating another embodiment of an image forming apparatus of the present invention.

FIG. 2 is a schematic view illustrating another embodiment of an image forming apparatus of the present invention. An image forming apparatus 100B is a tandem color image forming apparatus. The image forming apparatus 100B includes a main body 500, a paper feeding table 200, a scanner 300, and an automatic document feeder (ADF) 400.

An intermediate transfer medium 150 is provided in the center of the main body 500. The intermediate transfer medium 150, which is an endless belt, is stretched taut by support rollers 14, 15 and 16, and rotates in a clockwise direction.

A cleaning device 17, configured to remove residual toner particles remaining on the intermediate transfer medium 150, is provided close to the support roller 15. A tandem-type image forming device 120 including image forming units 18Y, 18C, 18M and 18K is provided facing the intermediate transfer medium 150 so that the image forming units 18Y, 18C, 18M and 18K are arranged in this order around the intermediate transfer medium 150 relative to the direction of rotation thereof.

Figure 3:
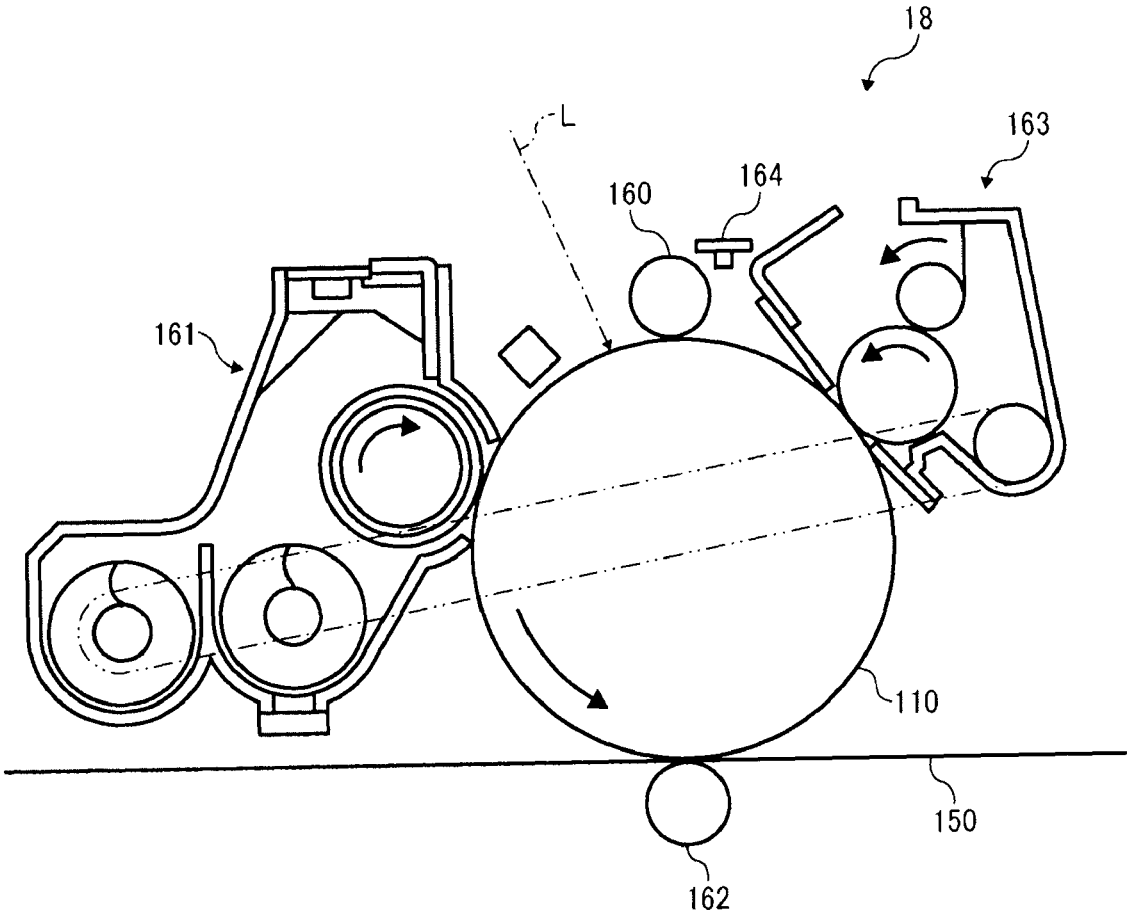
FIG. 3 is a schematic view illustrating an embodiment of an image forming unit included in the image forming apparatus illustrated in FIG. 2.

FIG. 3 is a schematic view illustrating an embodiment of each of the image forming units 18Y, 18C, 18M and 18K. Since the image forming units 18Y, 18C, 18M and 18K have the same configuration, only one image forming unit is illustrated in FIG. 3. Symbols Y, C, M and K, which represent each of the colors, are omitted from the reference number. The image forming unit 18 includes a photoreceptor 110, a charger 160 configured to uniformly charge the photoreceptor 110, a developing device 161 configured to develop the electrostatic latent image with a toner to form a toner image thereon, a transfer charger 162 configured to transfer the toner image onto the intermediate transfer medium 150, a cleaning device 163, and a decharging device 164.

Referring back to FIG. 2, a light irradiator 21 is provided close to the tandem-type image forming device 120. The light irradiator 21 directs a light beam L onto the photoreceptors 110Y, 110C, 110M, and 110K to respectively form electrostatic latent images thereon.

A secondary transfer device 22 is provided on the opposite side of the tandem-type image forming device 120 relative to the intermediate transfer medium 150. The secondary transfer device 22 includes a secondary transfer belt 24, which is an endless belt, stretched taut by a pair of rollers 23. A sheet of a recording paper fed on the secondary transfer belt 24 contacts the intermediate transfer medium 150.

A fixing device 25 is provided close to the secondary transfer device 22. The fixing device 25 includes a fixing belt 26, which is an endless belt, and a pressing roller 27 configured to press the fixing belt 26.

A reversing device 28 configured to reverse a sheet of the recording paper to form images on both sides thereof is provided close to the secondary transfer device 22 and the fixing device 25.

Next, a procedure for forming a full color image by the image forming apparatus 100B will be described. An original document is set to a document feeder 130 included in the automatic document feeder (ADF) 400, or placed on a contact glass 32 included in the scanner 300 by lifting up the automatic document feeder 400. When a start switch button, not shown, is pushed, the scanner 300 starts driving and a first runner 33 and a second runner 34 start moving. When the original document is set to the document feeder 31, the scanner 300 starts driving after the original document is fed on the contact glass 32. When the original document is placed on the contact glass 32, the scanner 300 starts driving immediately after the start switch button is pushed. The original document is irradiated with a light emitted by a light source via the first runner 33, and the light reflected from the original document is then reflected by a mirror included in the second runner 34. The light passes through an imaging lens 35 and is received by a reading sensor 36. Thus, image information of each color is read.

The light irradiator 21 irradiates each of the photoreceptors 110Y, 110C, 110M, and 110K with a light beam L containing image information corresponding to each color information to form an electrostatic latent image thereon. The electrostatic latent images thus formed are developed with the developers supplied from the developing devices 161Y, 161C, 161M, and 161K to form yellow, cyan, magenta, and black toner images, respectively. These yellow, cyan, magenta, and black toner images formed on the photoreceptors 110Y, 110C, 110M, and 110K, respectively, are independently transferred onto the intermediate transfer medium 150 in the primary transfer process and superimposed thereon one another so that a full-color toner image is formed.

On the other hand, referring back to FIG. 2, in the paper feeding table 200, a sheet of the recording paper is fed from one of multistage paper feeding cassettes 144, included in a paper bank 143, by rotating one of paper feeding rollers 142. A sheet of the recording paper is separated by separation rollers 145 and fed to a paper feeding path 146. The sheet of the recording paper is fed to a paper feeding path 148, included in the main body 500, by transport rollers 147, and is stopped by a registration roller 49. When a sheet of the recording paper is fed from a manual paper feeder 54, the sheet is separated by a separation roller 58 to be fed to a manual paper feeding path 53, and is stopped by the registration roller 49. The registration roller 49 is typically grounded, however, a bias can be applied thereto in order to remove paper powder.

The sheet of the recording paper is fed to an area formed between the intermediate transfer medium 150 and the secondary transfer device 22 by rotating the registration roller 49 in synchronization with an entry of the full-color toner image formed on the intermediate transfer medium 150. The full-color toner image is transferred onto the sheet of the recording paper by the secondary transfer device 22 in the secondary transfer process.

The sheet of the recording paper having the toner image thereon is fed from the secondary transfer device 22 to the fixing device 25. The toner image is fixed on the sheet of the recording paper by application of heat and pressure from the fixing belt 26 and the pressing roller 27 in the fixing device 25. The sheet of the recording paper is switched by a switch pick 55, ejected by an ejection roller 56, and stacked on an ejection tray 57. When the sheet of the recording paper is switched by the switch pick 55 to be reversed in the reverse device 28, the sheet of the recording paper is fed to a transfer area again in order to form a toner image on the backside thereof. The sheet of the recording paper having a toner image on the back side thereof is ejected by the ejection roller 56 and stacked on the ejection tray 57.

Toner particles remaining on the intermediate transfer medium 150 are removed by the cleaning device 17.

A process cartridge of the present invention is detachably attachable to an electrophotographic image forming apparatus, and comprises an electrostatic latent image bearing member to bear an electrostatic latent image and a developing device to develop the electrostatic latent image with the developer of the present invention to form a toner image. The process cartridge may optionally include other members, if needed.

The developing device includes the above-described container containing the developer of the present invention and a developer bearing member to bear and transport the developer, and may optionally include a layer thickness control member to control the thickness of the toner borne by the developer bearing member.

Figure 4:
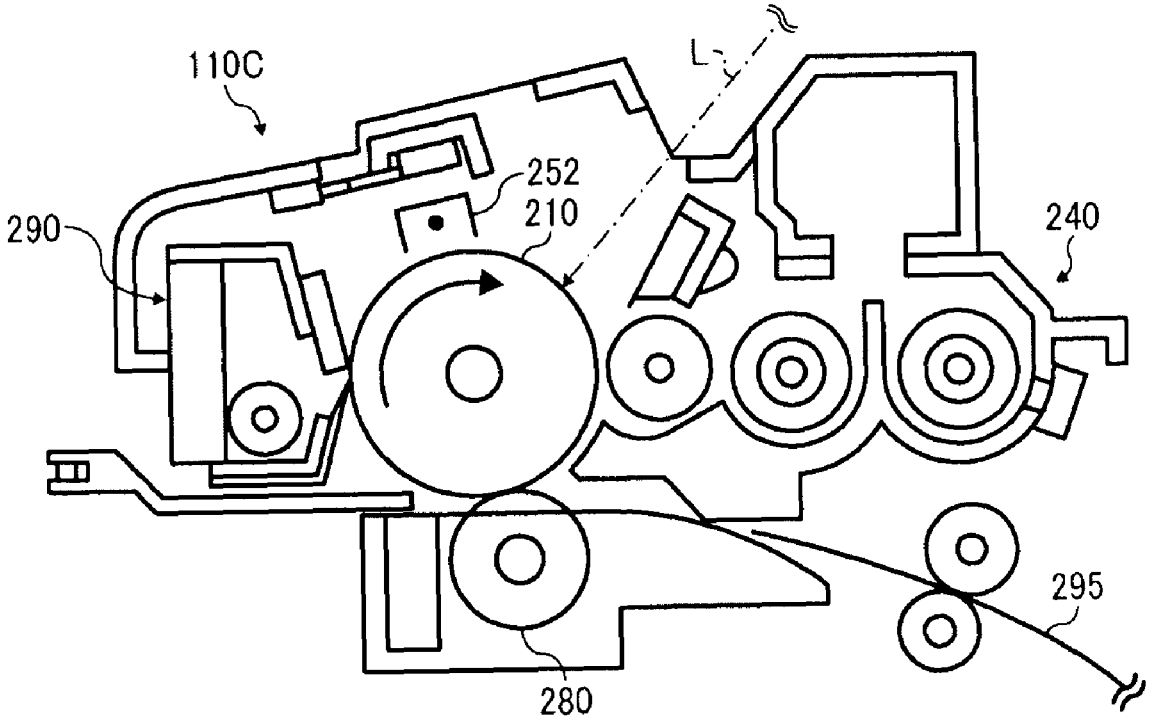
FIG. 4 is a schematic view illustrating an embodiment of a process cartridge of the present invention.

FIG. 4 is a schematic view illustrating an embodiment of a process cartridge according to the present invention.

A process cartridge 100C illustrated in FIG. 4 includes a photoreceptor 210, a corona charger 252, a developing device 240, a transfer roller 280, and a cleaning device 290. In FIG. 4, a reference numeral 295 denotes a recording medium.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Polyester Resin (A)

A reaction vessel equipped with a condenser, a stirrer, and a nitrogen inlet pipe is charged with 67 parts of ethylene oxide 2 mol adduct of bisphenol A, 84 parts of propylene oxide 3 mol adduct of bisphenol A, 274 parts of terephthalic acid, and 2 parts of dibutyltin oxide. The mixture is reacted for 10 hours at 230° C. at normal pressures, and subsequently for 6 hours under reduced pressures of 10 to 15 mmHg. Thus, a polyester resin (A) is prepared.

The polyester resin (A) has a number average molecular weight (Mn) of 2300, a weight average molecular weight (Mw) of 7000, a glass transition temperature (Tg) of 65° C., an acid value of 20 mgKOH/mg, and a hydroxyl value of 40 mgKOH/g.

Synthesis of Polyester Resin (B)

A reaction vessel equipped with a condenser, a stirrer, and a nitrogen inlet pipe is charged with 77 parts of ethylene oxide 2 mol adduct of bisphenol A, 74 parts of propylene oxide 3 mol adduct of bisphenol A, 289 parts of terephthalic acid, and 2 parts of dibutyltin oxide. The mixture is reacted for 8 hours at 230° C. at normal pressures, and subsequently for 5 hours under reduced pressures of 10 to 15 mmHg. Thus, a polyester resin (B) is prepared.

The polyester resin (B) has a number average molecular weight (Mn) of 2100, a weight average molecular weight (Mw) of 5600, a glass transition temperature (Tg) of 62° C., an acid value of 35 mgKOH/mg, and a hydroxyl value of 95 mgKOH/g.

Synthesis of Polyester Resin (C)

A reaction vessel equipped with a condenser, a stirrer, and a nitrogen inlet pipe is charged with 82 parts of ethylene oxide 2 mol adduct of bisphenol A, 69 parts of propylene oxide 3 mol adduct of bisphenol A, 294 parts of terephthalic acid, and 2 parts of dibutyltin oxide. The mixture is reacted for 8 hours at 230° C. at normal pressures, and subsequently for 5 hours under reduced pressures of 10 to 15 mmHg. Thus, a polyester resin (C) is prepared.

The polyester resin (C) has a number average molecular weight (Mn) of 2100, a weight average molecular weight (Mw) of 5600, a glass transition temperature (Tg) of 60° C., an acid value of 45 mgKOH/mg, and a hydroxyl value of 105 mgKOH/g.

Synthesis of Polyester Resin (D)

A reaction vessel equipped with a condenser, a stirrer, and a nitrogen inlet pipe is charged with 60 parts of ethylene oxide 2 mol adduct of bisphenol A, 92 parts of propylene oxide 3 mol adduct of bisphenol A, 265 parts of terephthalic acid, and 2 parts of dibutyltin oxide. The mixture is reacted for 8 hours at 230° C. at normal pressures, and subsequently for 5 hours under reduced pressures of 10 to 15 mmHg. Thus, a polyester resin (D) is prepared.

The polyester resin (D) has a number average molecular weight (Mn) of 2100, a weight average molecular weight (Mw) of 5600, a glass transition temperature (Tg) of 68° C., an acid value of 5 mgKOH/mg, and a hydroxyl value of 5 mgKOH/g.

Synthesis of Polyester Resin (E)

A reaction vessel equipped with a condenser, a stirrer, and a nitrogen inlet pipe is charged with 55 parts of ethylene oxide 2 mol adduct of bisphenol A, 97 parts of propylene oxide 3 mol adduct of bisphenol A, 260 parts of terephthalic acid, and 2 parts of dibutyltin oxide. The mixture is reacted for 8 hours at 230° C. at normal pressures, and subsequently for 5 hours under reduced pressures of 10 to 15 mmHg. Thus, a polyester resin (E) is prepared.

The polyester resin (E) has a number average molecular weight (Mn) of 2100, a weight average molecular weight (Mw) of 5600, a glass transition temperature (Tg) of 70° C., an acid value of 3 mgKOH/mg, and a hydroxyl value of 3 mgKOH/g.

Synthesis of Styrene-Acrylic Resin

A reaction vessel equipped with a condenser, a stirrer, and a nitrogen inlet pipe is charged with 300 parts of ethyl acetate, 200 parts of styrene, 100 parts of methyl acrylate, and 5 parts of azobisisobutyl nitrile. The mixture is reacted for 8 hours at 60° C. at normal pressures in nitrogen atmosphere. Further, 200 parts of methanol are added thereto and the mixture is agitated for 1 hour. After removing a supernatant liquid, the reaction product is dried under reduced pressures. Thus, a styrene-acrylic resin (A) is prepared.

The styrene-acrylic resin (A) has a weight average molecular weight (Mw) of 20000 and a glass transition temperature (Tg) of 60° C.

Synthesis of Ester Compounds

A fatty acid and an alcohol each having a specific composition are contained in a reaction vessel at a predetermined ratio, as described in Table 1-1, together with a catalyst. The mixture is subjected to an esterification reaction at 240° C. under nitrogen gas flow. Thus, ester compounds (1) to (8) are prepared.

The hydroxyl values and melting points of the ester compounds (1) to (8) are shown in Table 1-2.

TABLE 1-1

| Ester | Fatty Acid Composition (% by weight) | | | | Alcohol Composition (% by weight) | | | Molar Ratio |
|---|---|---|---|---|---|---|---|---|
| Compound No. | Stearic Acid | Behenic Acid | Lauric Acid | Palmitic Acid | Ethylene Glycol | Propylene Glycol | Butylene Glycol | (Fatty Acid/Alcohol) |
| (1) | 50 | 50 | 0 | 0 | 100 | 0 | 0 | 0.8/1.0 |
| (2) | 40 | 40 | 16 | 4 | 80 | 15 | 5 | 0.8/1.0 |
| (3) | 35 | 35 | 24 | 6 | 100 | 0 | 0 | 0.8/1.0 |
| (4) | 50 | 50 | 0 | 0 | 75 | 15 | 10 | 0.8/1.0 |
| (5) | 50 | 50 | 0 | 0 | 100 | 0 | 0 | 0.95/1.0 |
| (6) | 50 | 50 | 0 | 0 | 100 | 0 | 0 | 0.5/1.0 |
| (7) | 0 | 100 | 0 | 0 | 100 | 0 | 0 | 1.0/1.0 |
| (8) | 50 | 50 | 0 | 0 | 100 | 0 | 0 | 0.4/1.0 |

TABLE 1-2

| Ester Compound No. | Hydroxyl Value (mgKOH/g) | Melting Point (° C.) |
|---|---|---|
| (1) | 40 | 72 |
| (2) | 30 | 63 |
| (3) | 50 | 58 |
| (4) | 40 | 58 |
| (5) | 10 | 78 |
| (6) | 100 | 60 |
| (7) | 5 | 87 |
| (8) | 120 | 57 |

Preparation of Colorant Master Batch

First, 1000 parts of water, 540 parts of a carbon black (PRINTEX 35 from Evonik Degussa Japan, having a DBP oil absorption value of 42 ml/100 g and a pH of 9.5), and 1200 parts of the polyester resin (A) prepared above are mixed using a HENSCHEL MIXER (from Mitsui Mining Co., Ltd.). The mixture is kneaded for 30 minutes at 150° C. using a double-roll mill, and the kneaded mixture is then rolled and cooled. The rolled and cooled mixture is then pulverized using a pulverizer (from Hosokawa Micron Corporation). Thus, a master batch is prepared.

Preparation of Aqueous Medium

To prepare an aqueous medium, 306 parts of ion-exchange water, 265 parts of a 10% by weight suspension liquid of tricalcium phosphate, and 0.2 parts of sodium dodecylbenzene sulfonate are uniformly mixed.

Toner Example 1

In a beaker, 80 parts of the polyester resin (A) and 100 parts of ethyl acetate are contained and agitated so that the polyester resin (A) is dissolved in the ethyl acetate. Further, 5 parts of the ester compound (1) prepared above, 5 parts of a paraffin wax (HNP-11 from Nippon Seiro Co., Ltd.) having a melting point of 77° C., and 10 parts of the master batch are added thereto. The mixture is subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a toner constituent liquid is prepared.

Next, 150 parts of the aqueous medium are contained in a vessel, and 100 parts of the toner constituent liquid are added thereto while being agitated using a TK HOMOMIXER (from Primix Corporation) at a revolution of 12,000 rpm. The mixture is further mixed for 10 minutes. Thus, an emulsion slurry is prepared.

In a conical flask equipped with a stirrer and a thermometer, 100 parts of the emulsion slurry are contained, and agitated for 12 hours at 30° C. at a revolution of 20 m/min so that the solvent (i.e., ethyl acetate) are removed therefrom. Thus, a dispersion slurry is prepared.

Next, 100 parts of the dispersion slurry is filtered under a reduced pressure to obtain a wet cake. The wet cake thus obtained is mixed with 100 parts of ion-exchange water and the mixture is agitated for 10 minutes using a TK HOMOMIXER at a revolution of 12,000 rpm, followed by filtering. Thus, a wet cake (i) is prepared.

The wet cake (i) is mixed with 300 parts of ion-exchange water and the mixture is agitated for 10 minutes using a TK HOMOMIXER at a revolution of 12,000 rpm, followed by filtering. This operation is performed three times. Thus, a wet cake (ii) is prepared.

The wet cake (ii) is mixed with 10 parts of a 10% aqueous solution of hydrochloric acid and the mixture is agitated for 10 minutes using a TK HOMOMIXER at a revolution of 12,000 rpm, followed by filtering under a reduced pressure. Thus, a wet cake (iii) is prepared.

The wet cake (iii) is mixed with 300 parts of ion-exchange water and the mixture is agitated for 10 minutes using a TK HOMOMIXER at a revolution of 12,000 rpm, followed by filtering. This operation is performed twice. Thus, a wet cake (iv) was prepared.

The wet cake (iv) is dried for 48 hours at 45° C. using a circulating air drier, followed by sieving with a screen having openings of 75 μm. Thus, a mother toner is prepared.

Next, 100 parts of the mother toner and 1.0 part of a hydrophobized silica (H2000 from Clariant Japan K.K.) are mixed for 30 seconds at a revolution of 30 m/sec using a HENSCHEL MIXER (from Mitsui Mining Co., Ltd.), followed by pause for 1 minute. This mixing operation is repeated for 5 times. The mixture is sieved with a screen having openings of 35 μm. Thus, a toner is prepared. The dispersion diameter of the ester compound (1) in the toner is 0.2 μm.

Toner Example 2

The procedure for preparation of toner in Example 1 is repeated except that the polyester resin (A) is replaced with the polyester resin (B).

Toner Example 3

The procedure for preparation of toner in Example 1 is repeated except that the polyester resin (A) is replaced with the polyester resin (C).

Toner Example 4

The procedure for preparation of toner in Example 1 is repeated except that the polyester resin (A) is replaced with the polyester resin (D).

Toner Example 5

The procedure for preparation of toner in Example 1 is repeated except that the polyester resin (A) is replaced with the polyester resin (E).

Toner Example 6

The procedure for preparation of toner in Example 1 is repeated except that the ester compound (1) is replaced with the ester compound (2).

Toner Example 7

The procedure for preparation of toner in Example 1 is repeated except that the ester compound (1) is replaced with the ester compound (5).

Toner Example 8

The procedure for preparation of toner in Example 1 is repeated except that the ester compound (1) is replaced with the ester compound (6).

Toner Example 9

The procedure for preparation of toner in Example 1 is repeated except that the paraffin wax is replaced with a carnauba wax (WA-05 from Toa Kasei Co., Ltd.) having a meting point of 86° C.

Toner Example 10

The procedure for preparation of toner in Example 1 is repeated except that the amount of the ester compound (1) is changed from 5 parts to 3 parts and that of the polyester resin (A) is changed from 80 parts to 82 parts.

Toner Example 11

The procedure for preparation of toner in Example 1 is repeated except that the amount of the ester compound (1) is changed from 5 parts to 20 parts and that of the polyester resin (A) is changed from 80 parts to 65 parts.

Toner Example 12

The procedure for preparation of toner in Example 1 is repeated except that the amount of the ester compound (1) is changed from 5 parts to 2 parts and that of the polyester resin (A) is changed from 80 parts to 83 parts.

Toner Example 13

The procedure for preparation of toner in Example 1 is repeated except that the amount of the ester compound (1) is changed from 5 parts to 25 parts and that of the polyester resin (A) is changed from 80 parts to 60 parts.

Comparative Toner Example 1

The procedure for preparation of toner in Example 1 is repeated except that the amount of the ester compound (1) is changed from 5 parts to 0 part.

Comparative Toner Example 2

The procedure for preparation of toner in Example 1 is repeated except that the ester compound (1) is replaced with the ester compound (3).

Comparative Toner Example 3

The procedure for preparation of toner in Example 1 is repeated except that the ester compound (1) is replaced with the ester compound (4).

Comparative Toner Example 4

The procedure for preparation of toner in Example 1 is repeated except that the ester compound (1) is replaced with the ester compound (7).

Comparative Toner Example 5

The procedure for preparation of toner in Example 1 is repeated except that the ester compound (1) is replaced with the ester compound (8).

Comparative Toner Example 6

The procedure for preparation of toner in Example 1 is repeated except that the polyester resin (A) is replaced with the styrene-acrylic resin (A).

The compositions of the above-prepared toners and Tgr–Tgr' of the polyester resins used for the toners are shown in Table 2. Tgr and Tgr' are measured as follows.

First, about 5.0 mg of a polyester resin is contained in an aluminum specimen container. The specimen container is then loaded on a holder unit and set in an electric furnace. The specimen is heated from 20° C. to 150° C. at a heating rate of 10° C./min under nitrogen atmosphere, and subsequently cooled from 150° C. to 0° C. at a cooling rate of 10° C./min. The specimen is further heated to 150° C. at a heating rate of 10° C./min, while a DSC curve is measured by a differential scanning calorimetry system DSC-60 from Shimadzu Corporation. The DSC curve is analyzed by analysis software in the DSC-60so as to calculate Tgr. More specifically, Tgr is calculated from a shoulder in the DSC curve that is obtained in the second heating.

Tgr' is measured by the same method as well except that 0.5 mg of the fixing auxiliary component and 4.5 mg of the polyester resin is contained in the aluminum specimen container.

TABLE 2

| Toner | Resin | Ester Compound No. | Release Agent | Tgr-Tgr' |
|---|---|---|---|---|
| Example 1 | Polyester (A) | (1) | Paraffin | 15 |
| Example 2 | Polyester (B) | (1) | Paraffin | 18 |
| Example 3 | Polyester (C) | (1) | Paraffin | 25 |

TABLE 2-continued

| Toner | Resin | Ester Compound No. | Release Agent | Tgr-Tgr' |
|---|---|---|---|---|
| Example 4 | Polyester (D) | (1) | Paraffin | 12 |
| Example 5 | Polyester (E) | (1) | Paraffin | 8 |
| Example 6 | Polyester (A) | (2) | Paraffin | 18 |
| Example 7 | Polyester (A) | (5) | Paraffin | 7 |
| Example 8 | Polyester (A) | (6) | Paraffin | 20 |
| Example 9 | Polyester (A) | (1) | Carnauba | 15 |
| Example 10 | Polyester (A) | (1) | Paraffin | 15 |
| Example 11 | Polyester (A) | (1) | Paraffin | 15 |
| Example 12 | Polyester (A) | (1) | Paraffin | 15 |
| Example 13 | Polyester (A) | (1) | Paraffin | 15 |
| Comparative Example 1 | Polyester (A) | — | Paraffin | — |
| Comparative Example 2 | Polyester (A) | (3) | Paraffin | 20 |
| Comparative Example 3 | Polyester (A) | (4) | Paraffin | 20 |
| Comparative Example 4 | Polyester (A) | (7) | Paraffin | 3 |
| Comparative Example 5 | Polyester (A) | (8) | Paraffin | 25 |
| Comparative Example 6 | Styrene-Acrylic (A) | (1) | Paraffin | 5 |

Preparation of Carrier

To prepare a resin layer coating liquid, 100 parts of toluene, 100 parts of a silicone resin (organo straight silicone), 5 parts of γ-(2-aminoethyl)aminopropyl trimethoxysilane, and 10 parts of a carbon black are mixed for 20 minutes using a TK HOMOMIXER. The resin layer coating liquid is applied on the surfaces of 1000 parts of magnetite particles having an average particle diameter of 50 μm. Thus, a carrier is prepared.

Preparation of Developer

To prepare a developer, 5 parts of each of the above-prepared toners and 95 parts of the carrier are mixed using a ball mill.

Evaluations

The following evaluations are performed using the developer prepared above.

(1) Minimum Fixable Temperature

Each of the developers and a paper TYPE 6200 (from Ricoh Co., Ltd.) are set in a copier MF-200 (from Ricoh Co., Ltd.) employing a fixing roller using TEFLON®, in which the fixing part is modified. Images are produced by changing the temperature of the fixing roller in decrement of 5° C. to determine a minimum fixable temperature. The minimum fixable temperature is defined as a temperature below which the residual rate of image density after rubbing the fixed image is less than 70%. Preferably, the minimum fixable temperature is as low as possible, because of consuming lower amounts of power. A toner having a minimum fixable temperature of 135° C. or less has no problem in practical use.

(2) Hot Offset Temperature

A tandem color electrophotographic apparatus IMAGIO NEO C350 (from Ricoh Co., Ltd.) is modified such that a silicone oil applying mechanism is removed and a fixing unit is modified into an oilless fixing unit. The temperature and linear velocity thereof are controllable. Each of the developers is set in the tandem color electrophotographic apparatus thus modified, and the tandem color electrophotographic apparatus is adjusted so as to produce a toner image including 0.85±0.3 mg/cm$^2$ of a toner. The toner images are fixed by changing the temperature of the fixing roller in increments of 5° C., so that a temperature at and above which hot offset occurs (hereinafter "hot offset temperature") is determined.

Preferably, the hot offset temperature is as high as possible. A toner having a hot offset temperature of 190° C. or more has no problem in practical use.

(3) Transfer Rate

Each of the developers is set in an image forming apparatus MF2800 (from Ricoh Co., ltd.), and a black solid image having an area of 15 cm×15 cm and an image density of 1.38 or more, measured by a Macbeth reflective densitometer, is produced. The transfer rate is calculated from the following equation:

$$\text{Transfer Rate (\%)} = Tr/Tp \times 100$$

wherein Tr represents an amount of toner particles transferred onto a recording medium and Tp represents an amount of toner particles developed on a photoreceptor.

The transfer rate is graded into the following 4 levels.

A: not less than 90%

B: not less than 80% and less than 90%

C: not less than 70% and less than 80%

D: less than 70%

(4) Transfer Unevenness

Each of the developers is set in an image forming apparatus MF2800 (from Ricoh Co., ltd.), and a black solid image is produced. The produced black solid image is visually observed whether or not toner particles are unevenly transferred, and evaluated as follows.

A: No transfer unevenness is observed. Very good.

B: No transfer unevenness is observed. No problem in practical use.

C: Transfer unevenness is slightly observed, but no problem in practical use.

D: Transfer unevenness is observed. Not suitable for practical use.

(5) Fogging

Each of the developers is set in a tandem color electrophotographic apparatus IMAGIO NEO 450 (from Ricoh Co., Ltd.) employing a cleaning blade and a charging roller each being in contact with a photoreceptor, and 10, 000 sheets of an image pattern A are produced. The image pattern A is a lateral A4-size chart in which black solid images and white solid images are alternately arranged at intervals of 1 cm in a direction vertical to a direction of rotation of a developing sleeve. Subsequently, a white solid image is produced and visually observed whether or not fogging is caused.

A: Fogging is observed.

B: No fogging is observed.

(6) Formation of Toner Film

Each of the developers is set in an image forming apparatus MF2800 (from Ricoh Co., ltd. ) and 10, 000 sheets of an image are produced. Thereafter, the photoreceptor is visually observed whether or not toner components such as a release agent strongly adhere thereto, and evaluated as follows.

A: No toner component adheres to the photoreceptor.

B: Toner components are adhered to the photoreceptor, but no problem in practical use.

C: Toner components are adhered to the photoreceptor. Not suitable for practical use.

(7) Heat-Resistant Storage Stability

A 50-ml glass container is filled with each of the above-prepared toners. The glass container containing the toner is set in a constant-temperature chamber of 50° C. for 24 hours, and subsequently cooled to 24° C. The toner is subjected to a penetration test according to JIS K2235-1991. Heat-resistant storage stability is evaluated by the penetration as follows.

A: The penetration is not less than 25 mm.

B: The penetration is not less than 15 mm and less than 25 mm.

C: The penetration is not less than 5 mm and less than 15 mm.

D: The penetration is less than 5 mm.

The larger the penetration, the better the heat-resistant storage stability. Therefore, when the penetration is less than 5 mm, a problem may occur in practical use.

The evaluation results are shown in Table 3.

TABLE 3

| | Fixability | | Transferability | | Heat-resistant | | |
|---|---|---|---|---|---|---|---|
| Toner | Minimum Fixable Temperature (° C.) | Hot Offset Temperature (° C.) | Transfer Rate | Transfer Unevenness | Storage Stability | Fogging | Formation of Toner Film |
| Ex. 1 | 115 | 200 | A | A | B | A | A |
| Ex. 2 | 115 | 200 | A | B | B | A | A |
| Ex. 3 | 115 | 195 | B | B | C | A | A |
| Ex. 4 | 120 | 200 | A | A | A | A | A |
| Ex. 5 | 125 | 205 | A | A | A | A | A |
| Ex. 6 | 120 | 200 | A | B | C | A | A |
| Ex. 7 | 125 | 200 | A | A | B | A | A |
| Ex. 8 | 115 | 195 | A | B | B | A | A |
| Ex. 9 | 125 | 190 | A | A | B | A | A |
| Ex. 10 | 125 | 200 | A | A | B | A | A |
| Ex. 11 | 115 | 195 | B | B | B | A | A |
| Ex. 12 | 125 | 200 | A | A | B | A | A |
| Ex. 13 | 115 | 190 | B | B | C | A | A |
| Comp. Ex. 1 | 145 | 200 | A | A | B | A | A |
| Comp. Ex. 2 | 120 | 190 | C | C | D | B | C |
| Comp. Ex. 3 | 120 | 190 | C | C | D | B | C |
| Comp. Ex. 4 | 140 | 200 | A | A | B | A | A |
| Comp. Ex. 5 | 125 | 195 | C | C | D | B | C |
| Comp. Ex. 6 | 140 | 185 | B | B | C | B | A |

It is apparent from Table 3 that the toners of Example 1 to 13 each are excellent in both low-temperature fixability and hot offset resistance because of including a polyester resin having low-temperature fixability and a fixing auxiliary component which has specific hydroxyl value, monomer composition, and meting point of 60 to 85° C. so as to have compatibility with the polyester resin. The fixing auxiliary agents are ester compounds that can be form crystalline domains thereof. Therefore, the toners are also excellent in transferability and do not cause fogging and formation of toner film. Accordingly, these toners are capable of forming high-quality images for an extended period of time.

The toner of Comparative Example 1 is different from that of Example (1) in that no fixing auxiliary agent is included. As a result, low-temperature fixability is degraded.

The toner of Comparative Example 2 includes the ester compound which includes lower amounts of stearic acid and behenic acid. As a result, heat-resistant storage stability is degraded and fogging and formation of toner film are caused.

The toner of Comparative Example 3 includes the ester compound which includes a lower amount of ethylene glycol. As a result, transferability and heat-resistant storage stability are degraded and fogging and formation of toner film are caused.

The toner of Comparative Example 4 includes the ester compound which has a high melting point and a low hydroxyl value. Such an ester compound has poor compatibility with the polyester resin and does not sharply melt at low temperature. As a result, low-temperature fixability is degraded.

The toner of Comparative Example 5 includes the ester compound which has a low melting point and a high hydroxyl value. As a result, transferability and heat-resistant storage stability are degraded and fogging and formation of toner film are caused.

The toner of Comparative Example 6 includes the styrene-acrylic resin instead of the polyester resin. Since the styrene-acrylic resin inherently has poorer low-temperature fixability than the polyester resin and poorer compatibility with the fixing auxiliary component, low temperature fixability of the toner is degraded.

As described above, the toners of Examples 1 to 13 are suitable for use in low-temperature fixing system and rarely contaminate fixing devices and images because of having heat-resistant storage stability. Accordingly, the toner of the present invention provides high-quality images for an extended period of time.

This document claims priority and contains subject matter related to Japanese Patent Application No. 2008-044931, filed on Feb. 26, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:
a release agent;
a colorant;
a binder resin comprising a polyester resin; and
a fixing auxiliary component;
wherein:
the fixing auxiliary component comprises an ester compound of a fatty acid with an alcohol;
the fatty acid comprises stearic acid and behenic acid in a total amount of 80% by weight or more;
the alcohol comprises ethylene glycol in an amount of 80% by weight or more; and
the ester compound has a hydroxyl value of 10 to 100 mgKOH/g.

2. The toner according to claim 1, wherein the ester compound has a melting point of from 60 to 85° C.

3. The toner according to claim 1, wherein the release agent is a hydrocarbon wax having a melting point of from 60 to 90° C.

4. The toner according to claim 1, wherein the polyester resin has an acid value of from 5 to 40 mgKOH/g.

5. The toner according to claim 1, wherein the polyester resin has a hydroxyl value of from 5 to 100 mgKOH/g.

6. The toner according to claim 1, wherein the polyester resin has a glass transition temperature of from 55 to 80° C.

7. The toner according to claim 1, wherein the following equation is satisfied:

$$10^\circ\ \text{C.} \leqq Tgr - Tgr' \leqq 25^\circ\ \text{C.}$$

wherein:
Tgr represents a glass transition temperature of the polyester resin; and
Tgr' is a glass transition temperature of a mixture of 90 parts by weight of the polyester resin with 10 parts by weight of the fixing auxiliary component that is heated to 150° C.

8. The toner according to claim 1, wherein the toner comprises the fixing auxiliary component in an amount of from 3 to 20% by weight.

9. The toner according to claim 1, wherein the toner is manufactured by a method comprising:
dispersing the release agent, the colorant, the binder resin comprising a polyester resin, and the fixing auxiliary component in an organic solvent;
dispersing the resultant solution or dispersion in an aqueous medium; and
removing the organic solvent.

10. A developer, comprising the toner according to claim 1 and a carrier.

11. A toner container, comprising:
a case portion; and
the toner according to claim 1;
wherein the toner is provided in the case portion.

12. A process cartridge detachably attachable to an image forming apparatus, comprising:
an electrostatic latent image bearing member; and
a developing device configured to develop an electrostatic latent image formed on the electrostatic latent image bearing member with the toner according to claim 1.

13. An image forming method, comprising:
forming an electrostatic latent image on an electrostatic latent image bearing member;
developing the electrostatic latent image with the toner according to claim 1 to form a toner image;
transferring the toner image onto a recording medium; and
fixing the toner image on the recording medium.

14. An image forming apparatus, comprising:
an electrostatic latent image bearing member;
an electrostatic latent image forming device configured to form an electrostatic latent image on the electrostatic latent image bearing member;
a developing device configured to develop the electrostatic latent image with the toner according to claim 1 to form a toner image;
a transfer device configured to transfer the toner image onto a recording medium; and
a fixing device configured to fix the toner image on the recording medium.

* * * * *